US012398602B1

(12) United States Patent
Haldar et al.

(10) Patent No.: US 12,398,602 B1
(45) Date of Patent: Aug. 26, 2025

(54) MULTIPLE FAIL-SAFE VALVES FOR SAFETY OF COILED TUBING OPERATIONS

(71) Applicant: SAUDI ARABIAN OIL COMPANY, Dhahran (SA)

(72) Inventors: Surajit Haldar, Udhailiyah (SA); Sanjiv Kumar, Udhailiyah (SA); Fehead M. Al-Subaie, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/584,790

(22) Filed: Feb. 22, 2024

(51) Int. Cl.
*E21B 17/20* (2006.01)
*E21B 21/10* (2006.01)

(52) U.S. Cl.
CPC ..... *E21B 17/20* (2013.01); *E21B 21/10* (2013.01); *E21B 2200/05* (2020.05)

(58) Field of Classification Search
CPC ..... E21B 17/20; E21B 21/10; E21B 2200/05
See application file for complete search history.

(56) References Cited

U.S. PATENT DOCUMENTS

2011/0209881 A1* 9/2011 Hriscu ..... E21B 34/14 166/387
2014/0345742 A1* 11/2014 Andreychuk ..... E21B 17/023 228/144
2015/0226030 A1* 8/2015 Mackenzie ..... E21B 34/066 166/373
2016/0186538 A1* 6/2016 Acorda ..... E21B 43/14 166/313
2019/0345779 A1* 11/2019 Kennedy ..... E21B 17/206
2021/0254412 A1* 8/2021 Quero ..... E21B 17/20

OTHER PUBLICATIONS

Coiled tubing check valve, Double Flapper check valve, LIMAR, https://www.limaroiltools.com/coiled-tubing/standard-tools/double-flapper-check-valve (8 pages).

* cited by examiner

*Primary Examiner* — Taras P Bemko
(74) *Attorney, Agent, or Firm* — Osha Bergman Watanabe & Burton LLP

(57) ABSTRACT

A system includes coiled tubing configured to be lowered into a well using a reel. A bottom-hole assembly is connected to a downhole-most end of the coiled tubing. A fail-safe valve is installed within the coiled tubing at a location up-hole from the bottom-hole assembly. A fluid is configured to flow within the coiled tubing. The fail-safe valve is configured to prevent the fluid from flowing in an up-hole direction and permit the fluid from flowing in a downhole direction.

14 Claims, 4 Drawing Sheets

MULTIPLE FAIL-SAFE VALVES FOR SAFETY OF COILED TUBING OPERATIONS

BACKGROUND

Hydrocarbons are found in porous rock formations located beneath the Earth's surface. Wells are drilled into these formations to access and produce the hydrocarbons. During or after the process of drilling the well, coiled tubing may be used on the well to perform various operations. Coiled tubing is deployed in the well using a coiled tubing unit. Coiled tubing operations may be performed on the well for a myriad of reasons, e.g., drilling, fishing, workover, cementing, etc. Coiled tubing operations are often performed on the well when the well has, or has the potential for, pressure. As such, coiled tubing operations are associated with well control equipment to prevent well control incidents.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for well control in a coiled tubing string. The system includes coiled tubing configured to be lowered into a well using a reel; a bottom-hole assembly connected to a downhole-most end of the coiled tubing; a fail-safe valve installed within the coiled tubing at a location up-hole from the bottom-hole assembly; and a fluid configured to flow within the coiled tubing, wherein the fail-safe valve is configured to prevent the fluid from flowing in an up-hole direction and permit the fluid from flowing in a downhole direction.

The method includes forming coiled tubing by installing a fail-safe valve in the coiled tubing; connecting a bottom-hole assembly to a downhole-most end of the coiled tubing, wherein the bottom-hole assembly is installed at a location downhole from the fail-safe valve; lowering the coiled tubing into a well using a reel; allowing a fluid to flow in a downhole direction within the coiled tubing; and preventing the fluid from flowing in an up-hole direction within the coiled tubing.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
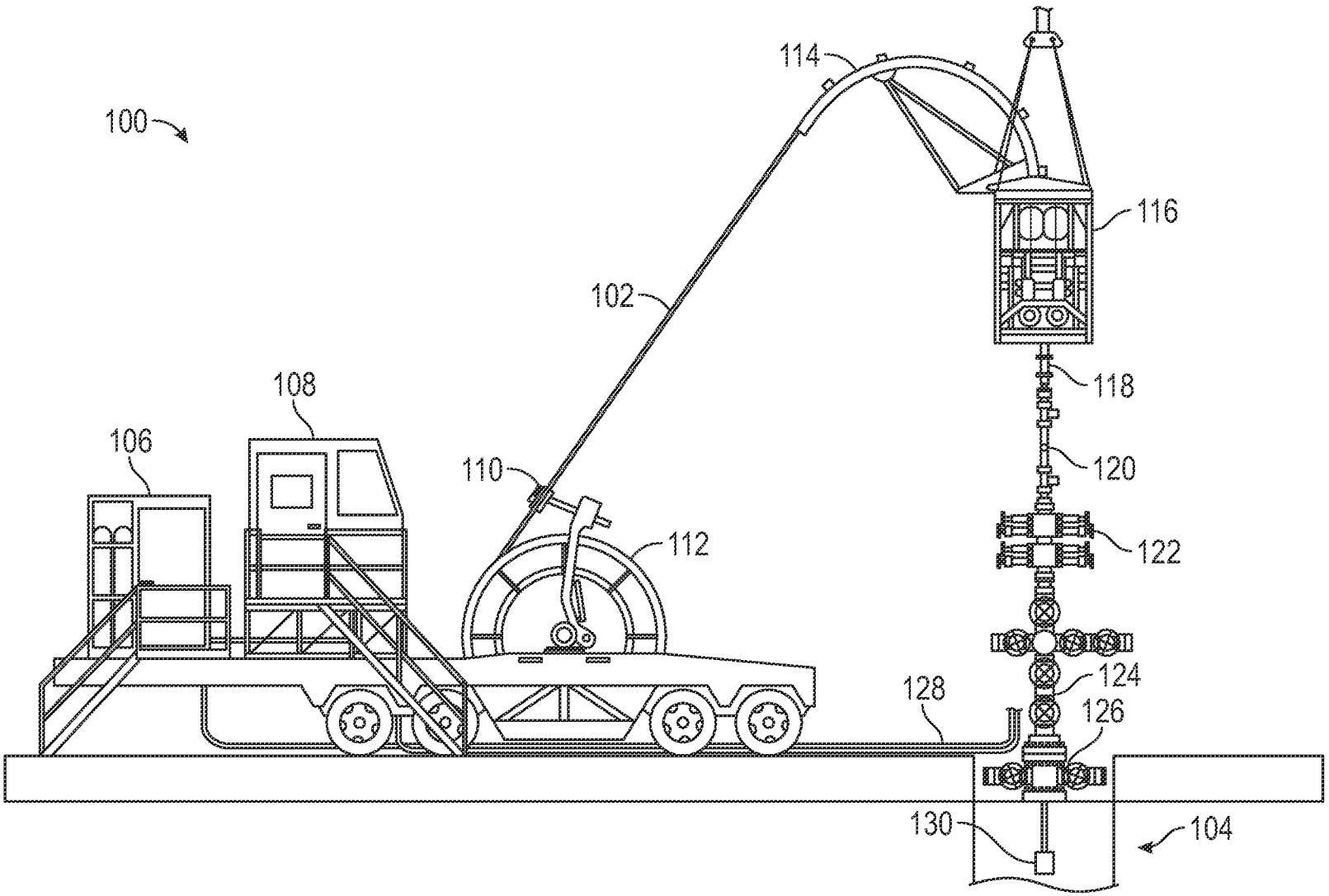
FIG. 1 shows a coiled tubing unit in accordance with one or more embodiments.

FIG. 1 shows a coiled tubing unit (100) in accordance with one or more embodiments. A person skilled in the art will appreciate that the coiled tubing unit (100) shown in FIG. 1 is used for example purposes only and any configuration of a coiled tubing unit (100) may be used without departing from the scope of the disclosure herein.

A coiled tubing unit (100) is used to deploy coiled tubing (102) into a well (104) to perform well operations. In accordance with one or more embodiments, coiled tubing operations may be appropriate where fluid circulation downhole is required, yet the full operational extent of a drilling rig or workover rig is not needed. For example, a coiled tubing unit (100) may be used to perform fishing operations, plug drill out operations, sidetrack operations, etc.

In accordance with one or more embodiments, the coiled tubing unit (100) comprises a power pack and accumulator unit (106), a control cabin (108), a spooler head (110), a reel (112), coiled tubing (102), a gooseneck (114), an injector head (116), a stripper mounting system (118), a lubricator (120), and a blow-out preventer (BOP) (122). The coiled tubing (102) is a continuous length of small-diameter pipe that is spooled around the reel (112).

In accordance with one or more embodiments, the tubing (102) is a steel alloy which enables the tubing (102) to be both flexible and strong. In particular, the tubing (102) is made of plates that are rolled into cylindrical-like shapes. Once rolled into the cylindrical-like shape, the rolled plates enter a welding arrangement that welds the ends of the plates together to produce a single tubular that is fed onto a reel (112) or storage drum. While the tubing (102) can be wound around the reel (112) without breaking or collapsing, the tubing (102) is permanently deformed by the curve to which it is bent. Thus, when the tubing (102) is spooled off the reel (112), it is slightly curved.

Because the plates of the coiled tubing (102) are formed into cylindrical-like shapes, the coiled tubing (102) comprises a conduit extending therein. When deployed in the well (104), the conduit enables fluid to be circulated into the well (104) via the coiled tubing (102). While not pictured, the coiled tubing unit (100) may also include fluid control equipment that may be similar to the fluid control equipment located on a drilling or workover rig. For example, the fluid control equipment may include pumps, pits, fluid/solids storage, separators, shale shakers, etc.

In accordance with one or more embodiments, the tubing (102) is deployed downhole by spooling the tubing (102) off of the reel (112) to be led into the well (104) via a gooseneck (114). The tubing (102) is spooled off the reel (112) using the injector head (116) and the spooler head (110). The injector head (116) pulls the tubing (102) off of the reel (112) while the spooler head (110) includes a brake that acts as a counter to the injector head (116) so that the reel (112) does not spin the entire length of the tubing (102) into the well (104). Furthermore, the reel (112) may include a motor that rolls the reel (112) to feed the tubing (102) into the injector head (116). The gooseneck (114) guides the tubing (102) from the spooler head (110) into the injector head (116). The gooseneck (114) is designed to redirect the tubing (102) without further deforming the tubing (102). When the tubing (102) passes through the injector head (116), it is slightly straightened due to the forces applied to the tubing (102) via components within the injector head (116).

When the tubing (102) is pulled out of the well (104), the direction of travel on the injector head (116) is reversed so that the injector head (116) pulls tubing (102) from the well (104) rather than from the reel (112). As the injector head (116) pulls the tubing (102) from the well (104), the reel (112) rotates via the motor to enable the tubing (102) to be re-spooled onto the reel (112).

In accordance with one or more embodiments, the injector head (116) includes one or more hydraulic systems that allow a coiled tubing unit (100) to operate with a high degree of operational variability. Specifically, the hydraulic systems enable the injector head (116) to have pushing and pulling capabilities. The injector head (116) further includes special profiled chain assemblies that grip the tubing (102). The hydraulic systems and the chain assemblies work in tandem. The hydraulic system provides the driving means and the chain assemblies physically grip onto the tubing (102) and transfer the driving means to the tubing (102).

In accordance with one or more embodiments, the base of the injector head (116) is secured to the pressure control equipment (i.e., the lubricator (120) and the BOP (122)) via a stripper mounting system (118). The stripper mounting system (118) may include any stripper or stuffing box equipment known in the art. For example, the stripper mounting system (118) may include a side door stripper, tandem strippers, etc. The stripper mounting system (118) is the primary sealing mechanism for isolating wellbore pressure under static or dynamic operating conditions. Specifically, the stripper mounting system (118) provides a pressure seal around the tubing (102) when it is being run into or pulled from the well (104). The sealing mechanism is activated by hydraulic pressure.

In accordance with one or more embodiments, the lubricator (120) is made of high-pressure-rated pipe and is used to equalize pressure when running tools into the well (104). The lubricator (120) is installed on top of the BOP (122). The BOP (122) provides secondary and contingency pressure-control functions similar to conventional BOPs used on drilling and workover rigs.

In accordance with one or more embodiments, the BOP (122) is installed on top of a tree (124) and the tree (124) is installed on top of a wellhead (126). The wellhead (126) houses the surface-extending portion of the various casing strings installed in the well (104). The wellhead (126) is conventionally known as the surface-extending portion of the well (104). The tree (124) is a set of valves, spools, and fittings that are connected to the wellhead (126) to direct and control the flow of fluids and tools into or out of the well (104).

In accordance with one or more embodiments, the coiled tubing unit (100) comprises a control cabin (108). The control cabin (108) contains all the necessary controls for operating a coiled tubing unit (100). For example, the control cabin (108) includes computers and controls that connect to the injector head (116), reel (112), and spooler head (110), such that an operator can control the direction and speed of these pieces of equipment.

In accordance with one or more embodiments, the coiled tubing unit (100) comprises a power pack and accumulator unit (106). The power pack and accumulator unit (106) provides hydraulic power to control and operate the injector head (116), spooler head (110), and pressure control equipment (i.e., stripper mounting system (118), lubricator (120), BOP (122)). Specifically, the coiled tubing unit (100) comprises hydraulic lines (128) that transport the hydraulic fluid to the equipment to power the equipment. In further embodiments, the power pack and accumulator unit (106) further includes electric or diesel power sources to power any electric equipment located in the coiled tubing unit (100).

In accordance with one or more embodiments, a bottom-hole assembly (BHA) (130) is located on the downhole-most end of the tubing (102). The BHA (130) may have a myriad of configurations depending on the operation. For example, the BHA (130) may include a mud motor and a drill bit. The mud motor may operate using a flow of fluid pumped through the tubing (102). The mud motor may rotate the drill bit to drill through material in the well (104).

The BHA (130) may also include a standalone tool with two check valves. The purpose of the stand alone tool is to prevent back flow of fluid into the tubing (102) from the well (104). However, due to the volatile operations performed by coiled tubing units (100), situations occur when the BHA is partially or totally lost in the well (104). In such scenarios, there is no barrier against fluids flowing from the well (104) into the tubing. As such, a reverse flow of reservoir fluid can enter inside the interior of the tubing (102). These fluids may include toxic materials such as hydrogen sulfide (H2S) gas, acid, and combustible hydrocarbons. This creates a well control scenario creating threats to the safety of personnel working at well site or living in the nearby area. As such, equipment that may be used in a coiled tubing unit (100) that prevents back flow of fluid through the tubing (102) and is not reliant upon the BHA (130) is beneficial.

The present disclosure outlines a method of using multiple check valves at different intervals along the tubing (102) to reduce or eliminate the risk of reverse flow significantly during coiled tubing operations. The fail-safe valves may be strategically placed along the coiled tubing (102) during manufacturing of the coiled tubing (102) as per the requirement and preference of the customer and operator. In particular, the number of valves and the intervals between each valve may be determined depending on reservoir conditions.

Figure 2:
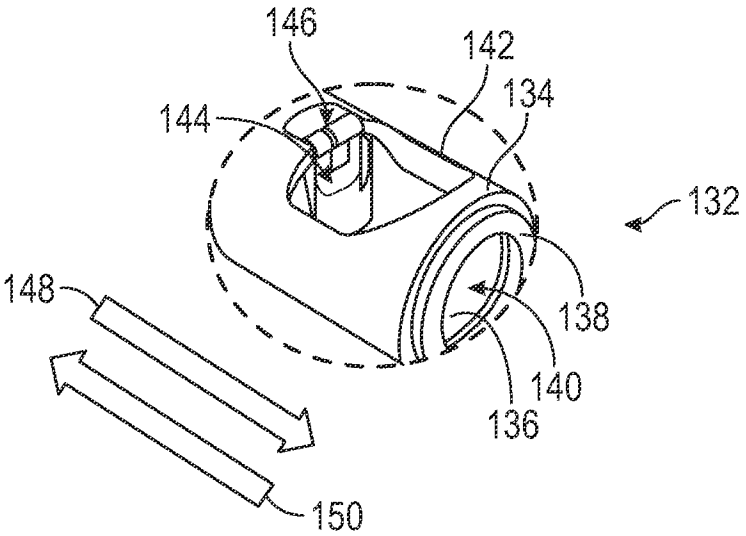
FIG. 2 shows a fail-safe valve in accordance with one or more embodiments.

FIG. 2 shows a fail-safe valve (132) in accordance with one or more embodiments. The fail-safe valve (132) includes an outer circumferential surface (134) and an inner circumferential surface (136). A wall (138) is located between the outer circumferential surface (134) and the inner circumferential surface (136). A conduit (140) is delineated by the inner circumferential surface (136) and the wall (138).

A valve seat (142) comprises a flapper (144) and a hinge (146) secured by a pin. The flapper (144) is only able to move and fully open when a fluid flows through the fail-safe valve (132) in a downhole direction (148). When the fluid flows in the downhole direction (148), the pressure exerted on the flapper (144) overcomes the pressure of the hinge (146) holding the flapper (144) against (or near) the valve seat (142) and the flapper (144) may fully open to allow the fluid to flow past the flapper (144). However, when the fluid flows in an up-hole direction (150), the fluid is unable to push open the flapper (144). Rather the pressure of the fluid flowing in the up-hole direction (150) presses the flapper (144) against the valve seat (142). As such, the fluid is unable to flow past the flapper (144).

Figure 3:
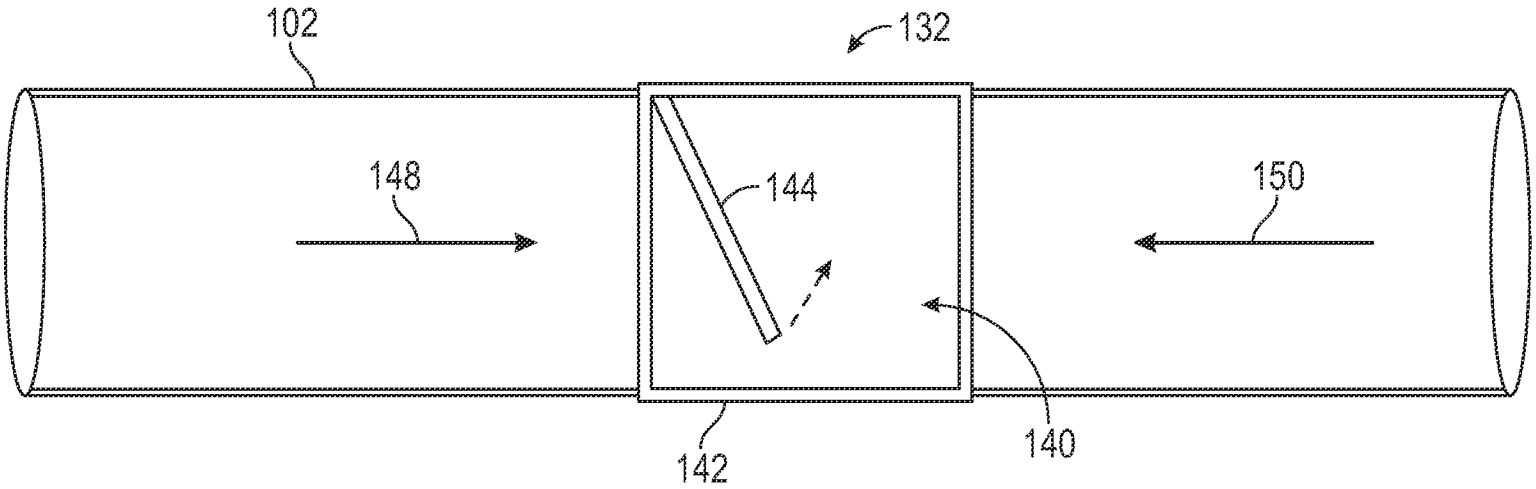
FIG. 3 shows a cross section of the fail-safe valve installed in the tubing of the coiled tubing unit in accordance with one or more embodiments.

FIG. 3 shows a cross section of the fail-safe valve (132) installed in the tubing (102) of the coiled tubing unit (100) in accordance with one or more embodiments. Components shown in FIG. 3 that are the same as or similar to components shown in FIGS. 1 and 2 have not been re-described for purposes of readability and have the same description and function as outlined above.

FIG. 3 emphasizes the operation of the flapper (144) of the fail-safe valve (132) depending on the direction of fluid flow. As outlined above, when fluid flows in an up-hole direction (150), the flapper (144) is pressed against the valve seat (142) and the fluid is unable to pass through the flapper (144). However, when fluid flows in a downhole direction (148), the fluid is able to open the flapper (144) using the hinge (146) and the fluid is able to flow past the flapper (144) into the well (104).

In accordance with one or more embodiments, the fail-safe valve (132) is installed in the tubing (102) during the manufacturing of the tubing (102). For example, the fail-safe valve (132) may be located between two neighboring sheets after they are formed into the cylinder-like shapes and the neighboring sheets may be welded to the fail-safe valve (132). The manufacturing of the fail-safe valve (132) in this manner ensures that the internal diameter (ID) of the coiled tubing (102) is maintained. In accordance with one or more embodiments, if there is loss of effective ID, this loss may be compensated with increased outer diameter (OD) utilizing a Continuous Variable Reduction (CVR) process during manufacturing.

In accordance with one or more embodiments, the CVR process has the ability to change many variables that exist in a coiled tubing (102), such as outside diameter, wall thickness, inside diameter, and material strength. All of these variables can be varied within the same length of tubing.

The CVR process begins in much the same way as conventional manufacturing process where multiple steel strips are joined end-to-end to create a longer continuous strip. After joining the strips and inspecting the joints quality, the joined strips are then fed into a machine called an accumulator. The accumulator stores a large length of joined strips to allow the tube forming mill to continuously pull from.

This is a recommended manufacturing process of the coiled tubing (102) that would help to accommodate multiple fail-safe valves (132) along the long coiled tubing (102) without compromising with the strength of the coiled tubing (102) materials.

Figure 4:
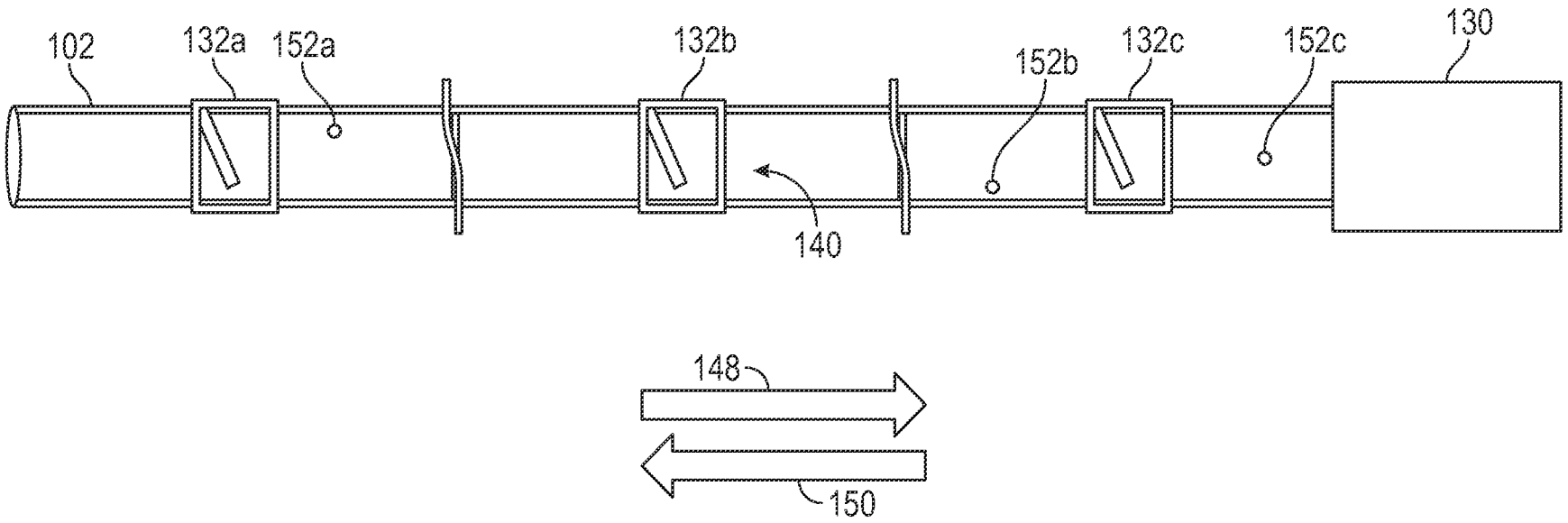
FIG. 4 shows a cross section of three fail-safe valves installed in the tubing of the coiled tubing unit in accordance with one or more embodiments.

FIG. 4 shows a cross section of three fail-safe valves (132*a-c*) installed in the tubing (102) of the coiled tubing unit (100) in accordance with one or more embodiments. Components shown in FIG. 4 that are the same as or similar to components shown in FIGS. 1-3 have not been re-described for purposes of readability and have the same description and function as outlined above. A person skilled in the art will appreciate that the number and location of the fail-safe valves (132*a-c*) are used for example purposes and any number and location of the fail-safe valves (132*a-c*) outside of the BHA (130) may be used without departing from the scope of the disclosure herein.

FIG. 4 shows a first fail-safe valve (132*a*), a second fail-safe valve (132*b*), and a third fail-safe valve (132*c*) installed at different points along the tubing (102). As is shown in FIG. 4, none of the fail-safe valves (132*a-c*) are installed in the BHA (130). Rather, each fail-safe valve (132*a-c*) is manufactured into the tubing (102), as outlined above. The number of fail-safe valve (132*a-c*) and the intervals between each fail-safe valve (132*a-c*) may be determined by the manufacturer, operator, or client depending on the reservoir conditions. In accordance with one or more embodiments, spacing between two fail safe valves (132*a-c*) is may be no less than one thousand feet due to safety factors. This spacing can be optimized during the manufacturing stage depending on the oil field's characteristic, reservoir conditions and well type.

For example, there may be known or potential leak points along the tubing (102) and the fail-safe valves (132*a-c*) may be installed above (i.e., up-hole from) each leak point as to prevent fluid migration in the up-hole direction (150) if a leak occurs along the tubing (102). FIG. 4 shows three potential leak points (152*a-c*): a first leak point (152*a*), a second leak point (152*b*), and a third leak point (152*c*).

In accordance with one or more embodiments, the first fail-safe valve (132*a*) is installed up-hole from the first leak point (152*a*), the second fail-safe valve (132*b*) is installed up-hole from the second leak point (152*b*), and the third fail-safe valve (132*c*) is installed up-hole from the third leak point (152*c*). If the tubing (102) leaks or becomes disconnected at any of the leak points (152*a-c*), there will always be at least one fail-safe valve (132*a-c*) that is located up-hole from the leak point (152*a-c*). Thus, there will always be a barrier within the tubing (102) so that the wellbore fluids cannot migrate to the surface through the tubing (102).

In accordance with one or more embodiments and as shown in FIG. 4, the fail-safe valves (132*a-c*) may be designed to always be slightly open until a fluid begins to flow through the fail-safe valve (132*a-c*) in the up-hole direction (150). The fail-safe valves (132*a-c*) may be designed to stay slightly open to ensure that there is no pressure trap or fluid (liquid or gas) trapped inside the coiled tubing (102). Furthermore, attaching a dual check valve as part of the BHA (130) is optional because of the fail-safe valves (132*a-c*) installed in the coiled tubing (102).

Figure 5:
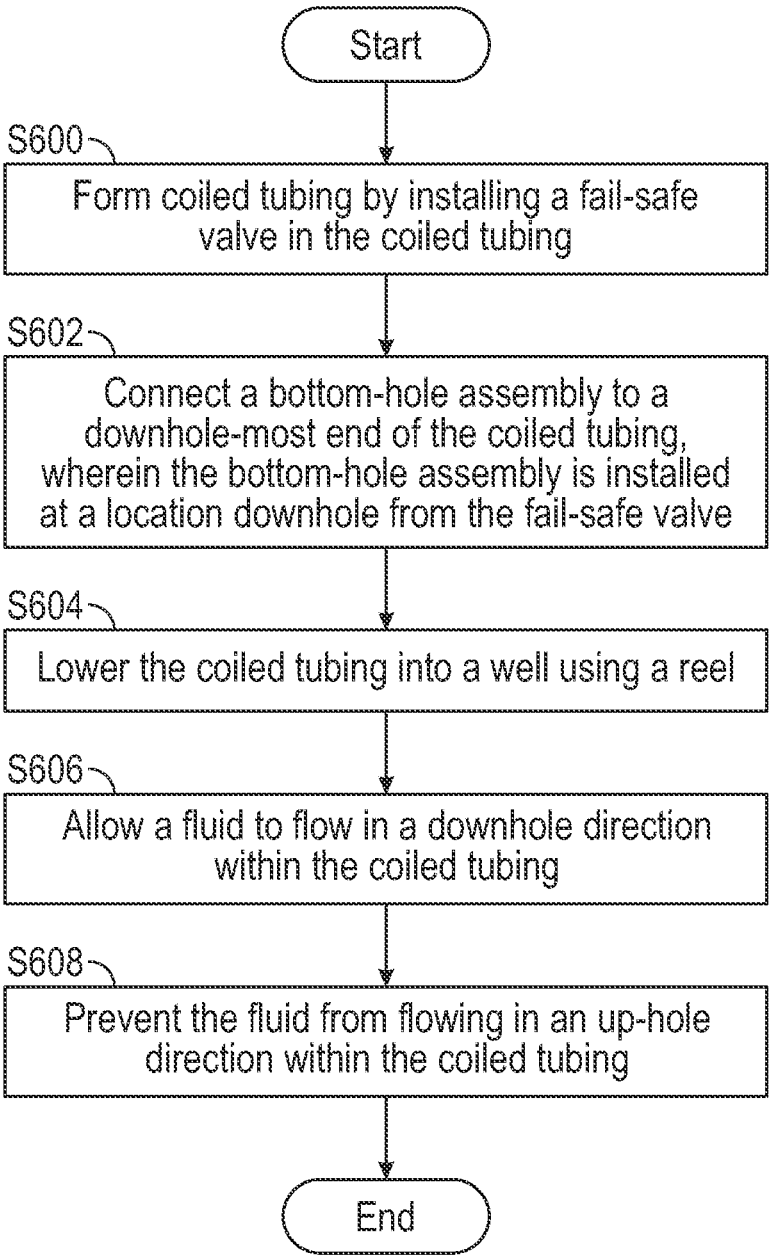
FIG. 5 shows a flowchart in accordance with one or more embodiments.

FIG. 5 shows a flowchart in accordance with one or more embodiments. The flowchart outlines a method for using a coiled tubing unit (100). While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S600, coiled tubing (102) is formed by installing a fail-safe valve (132*a-c*) in the coiled tubing (102). In accordance with one or more embodiments, the coiled tubing (102) is formed by rolling metal plates into cylindrical-like shapes, welding the rolled metal plates to form a continuous length of the coiled tubing (102), and wrapping the coiled tubing (102) around the reel (112).

In accordance with one or more embodiments, the fail-safe valve (132*a-c*) is formed by installing a flapper (144) in a valve seat (142) where movement of the flapper (144) within the valve seat (142) is controllable using a hinge (146). The fail-safe valve (132*a-c*) may be installed in the coiled tubing (102) by welding the fail-safe valve (132*a-c*) between two corresponding metal plates rolled into the cylindrical-like shapes.

In accordance with one or more embodiments, the location of the fail-safe valve (132*a-c*) along the coiled tubing (102) is determined during the manufacturing stage and may depend on the oil field's characteristic, reservoir conditions, and well type. In accordance with one or more embodiments, the location of the fail-safe valve (132*a-c*) along the coiled tubing (102) may be based on pre-determined leak point (152*a-c*) locations. The leak points (152*a-c*) may be probable failure points of the coiled tubing (102) or may be probable severance points of the coiled tubing (102) during operations.

The fail-safe valve (132*a-c*) should be installed at an up-hole location of the leak point (152*a-c*). For example, there may be a first leak point (152*a*), a second leak point (152*b*), and third leak point (152*c*). As such, a first fail-safe valve (132*a*) may be installed up-hole from the first leak point (152*a*), a second fail-safe valve (132*b*) may be installed up-hole from the second leak point (152*b*), and a third fail-safe valve (132*c*) may be installed up-hole from the third leak point (152*c*).

In S602, a BHA (130) is connected to a downhole-most end of the coiled tubing (102), wherein the BHA (130) is installed at a location downhole from the fail-safe valve (132*a-c*). In accordance with one or more embodiments, the BHA (130) is installed downhole from the fail-safe valve (132*a-c*) in case the BHA (130) is lost in the well (104).

In S604, the coiled tubing (102) is lowered into a well (104) using a reel (112). The reel (112) may be a part of a coiled tubing unit (100) operating on a well (104), as outlined in FIG. 1. In accordance with one or more embodiments, the coiled tubing (102) may be used in a well (104) having more than 10,000 parts-per-million hydrogen sulfide or a well with more than ten percent carbon dioxide.

Prior to running the coiled tubing (102) into the well (104), a non-destructive test may be performed especially if the coiled tubing (102) has been idle for more than three months. After a coiled tubing operation has been performed, the coiled tubing (102) may be purged with nitrogen gas and a non-destructive test may be performed on the coiled tubing (102) to ensure proper functioning of the fail-safe valves (132*a-c*).

In accordance with one or more embodiments, a non-destructive test is applied periodically as part of routine maintenance to evaluate the properties, components, structures, or system without causing any damage to the material to be tested or investigated (in this case, this is a routine health test of the coiled tubing (102)). Examples of the non-destructive test includes visual inspection for signs of wear and tear, radiography using X-rays or gamma rays to examine the internal structure of the tubing (102), ultrasonic testing, magnetic particle testing, and/or penetration testing using chemicals to identify surface breaking defects of the coiled tubing (102). Such non-destructive testing is required after completion of each job or multiple jobs or prior to deployment in a well (104) to ensure internal and external integrity of the coiled tubing (102).

In S606, a fluid is allowed to flow in a downhole direction (148) within the coiled tubing (102). The fluid may flow in a downhole direction (148) during normal operations of the coiled tubing (102), which may include jobs that require circulating fluid into the tubing (102) and subsequently into the well ( ).

In S608, the fluid is prevented from flowing in an up-hole direction (150) within the coiled tubing (102). The fluid may be flowing in the up-hole direction (150) due to one of the leak points (152*a-c*) or the BHA (130) being separated from the coiled tubing (102) during an operation. In accordance with one or more embodiments, the fluid is prevented from flowing in the up-hole direction (150) by pushing the flapper (144) into the valve seat (142) using a pressure exerted on the flapper (144) by the fluid to block a conduit (140) of the fail-safe valve (132*a-c*).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A coiled tubing unit comprising:

coiled tubing configured to be lowered into a well using a reel;

a bottom-hole assembly connected to a downhole-most end of the coiled tubing;

a fail-safe valve installed within the coiled tubing at a location up-hole from the bottom-hole assembly, wherein the fail-safe valve is installed within the coiled tubing using a continuous variable reduction manufacturing process; and a fluid configured to flow within the coiled tubing, wherein the fail-safe valve is configured to prevent the fluid from flowing in an up-hole direction and permit the fluid to flow in a downhole direction.

2. The coiled tubing unit of claim 1, wherein the fail-safe valve comprises a flapper located in a valve seat and controllable using a hinge.

3. The coiled tubing unit of claim 2, wherein the fail-safe valve is configured to prevent the fluid from flowing in the up-hole direction by the fluid pushing the flapper into the valve seat, using the hinge, to block a conduit of the fail-safe valve.

4. The coiled tubing unit of claim 1, wherein the coiled tubing comprises a leak point and the fail-safe valve is installed on the coiled tubing at a location up-hole from the leak point, wherein the leak point is a probable failure or severance point along the coiled tubing.

5. The coiled tubing unit of claim 1, wherein the coiled tubing comprises a first leak point, a second leak point, and third leak point, wherein the first leak point, the second leak point, and the third leak point are probable failure or severance points along the coiled tubing.

6. The coiled tubing unit of claim 5, wherein the fail-safe valve comprises a first fail-safe valve, a second fail-safe valve, and a third fail-safe valve.

7. The coiled tubing unit of claim 6, wherein the first fail-safe valve is installed up-hole from the first leak point, the second fail-safe valve is installed up-hole from the second leak point, and the third fail-safe valve is installed up-hole from the third leak point.

8. A method comprising:

forming coiled tubing by installing a fail-safe valve in the coiled tubing, wherein the fail-safe valve is installed in the coiled tubing using a continuous variable reduction manufacturing process;

connecting a bottom-hole assembly to a downhole-most end of the coiled tubing, wherein the bottom-hole assembly is installed at a location downhole from the fail-safe valve;

lowering the coiled tubing into a well using a reel;

allowing a fluid to flow in a downhole direction within the coiled tubing; and preventing the fluid from flowing in an up-hole direction within the coiled tubing.

9. The method of claim 8, further comprising forming the fail-safe valve by installing a flapper in a valve seat, wherein movement of the flapper is controllable using a hinge.

10. The method of claim 9, wherein preventing the fluid from flowing in an up-hole direction within the coiled tubing further comprises pushing the flapper into the valve seat using a pressure exerted on the flapper by the fluid to block a conduit of the fail-safe valve.

11. The method of claim 8, wherein the coiled tubing comprises a leak point and the fail-safe valve is installed on the coiled tubing at a location up-hole from the leak point, wherein the leak point is a probable failure or severance point along the coiled tubing.

12. The method of claim 8, wherein the coiled tubing comprises a first leak point, a second leak point, and third leak point, wherein the first leak point, the second leak point, and the third leak point are probable failure or severance points along the coiled tubing.

13. The method of claim 12, wherein the fail-safe valve comprises a first fail-safe valve, a second fail-safe valve, and a third fail-safe valve.

14. The method of claim 13, wherein installing the fail-safe valve in the coiled tubing further comprises installing the first fail-safe valve up-hole from the first leak point, installing the second fail-safe valve up-hole from the second leak point, and installing the third fail-safe valve up-hole from the third leak point.

* * * * *